US005088770A

United States Patent [19]

McCrea

[11] Patent Number: 5,088,770

[45] Date of Patent: Feb. 18, 1992

[54] RECORD SYSTEM FOR BOOKS AND OTHER LOANED ARTICLES

[76] Inventor: Marguerite J. McCrea, 1571 Dry Creek Rd., San Jose, Calif. 95125

[21] Appl. No.: 604,978

[22] Filed: Oct. 29, 1990

[51] Int. Cl.[5] ..... B42D 9/00

[52] U.S. Cl. ..... 283/105; 283/42; 281/42

[58] Field of Search ..... 281/5, 38, 42; 282/16 B; 283/61, 67, 100, 105, 98, 99, 38, 40, 42; 116/234, 238, 239

[56] References Cited

U.S. PATENT DOCUMENTS

| | | | |
|---|---|---|---|
| 685,151 | 10/1901 | Landing | 283/105 X |
| 2,223,089 | 11/1940 | Beuglet | 283/105 X |
| 2,363,919 | 11/1944 | Williams | 283/105 X |
| 4,448,443 | 5/1984 | Jones | 281/5 |

*Primary Examiner*—Timothy V. Eley

*Assistant Examiner*—Peter Dungba Vo

*Attorney, Agent, or Firm*—Thomas M. Freiburger

[57] ABSTRACT

For keeping a record of books and other articles lent to friends by a lender, a pad or stack of paper sheets or tickets are bound together. Each has a portion to be retained in the bound pad or stack, with provision for entry of information by the owner/lender as to the identity of the borrower and of the article, the date, etc. A second portion of each sheet or ticket serves as or includes a tear-off or pull-off piece on which is entered or preprinted the name of the article's owner, address, phone number and/or the date borrowed. The removable portion can be an end portion of the ticket or sheet, or it can be a removable adhesive sticker, for adhering onto the article to be borrowed, as a reminder of the owner's identity and the date borrowed. In one specific embodiment, the tear-off portion becomes a bookmark for use in a book to be read by the borrower.

7 Claims, 4 Drawing Sheets

RECORD SYSTEM FOR BOOKS AND OTHER LOANED ARTICLES

BACKGROUND OF THE INVENTION

This invention is concerned generally with providing an owner's record of articles loaned, so that they may later be retrieved. More specifically, the invention concerns a method and system for the orderly entry of and retention of information relating to books or other articles loaned, with reminder information presented to both the borrower and the lender.

Books, phonograph records, audio tapes, video tapes, compact audio discs and many other articles which have been read or used one or more times by the owner, are often lent to others. Particularly in the case of books, a great deal of time often passes before the borrower is finished using the article. Without any intention to deprive the owner of the book or other article, the borrower often cannot return the article for lack of recollection from whom the article was borrowed. At the same time, the owner and lender has no record of to whom the article was loaned, when the article was loaned, or even of ever having loaned or owned the article.

Previous to the present invention, there have been a number of tear-off paper devices, such as for use in the sale of tickets or in coupons for ordering items or for the paying of bills by mail, wherein one portion is retained and another portion is given out, sent with payment, etc. However, none of these has been structured similarly to or used in the manner of the present invention described below.

SUMMARY OF THE INVENTION

The device, system and method of the present invention enable a lender to efficiently keep track of books and other articles lent to borrowers. Every time an article is to be lent to a borrower, before the article leaves the owner's possession an entry of information is made on a permanent record to be retained by the lender, identifying the borrower and the article borrowed. The date of the loan and other pertinent information may also be entered, if desired. The permanent record comprises a stack or pad or sheaf of ticket-like sheets or strips, having spaces for the orderly entry of the pertinent information. This information is entered on a first portion of each sheet or strip, with a second portion being removable for attachment to or insertion in the article being loaned.

The second portion has spaces designated for the entry of information identifying the owner/lender of the article, or each second portion can be pre-printed with this information. The date of the loan can be entered on the second portion.

Before the article is released by the lender, the second portion is torn off or otherwise removed from the first, bearing the information at least relating to the identity of the owner/lender, and is inserted in, attached to or adhered to the article being loaned. This serves as a reminder to the borrower, as to the identity of the owner/lender of the article. The date of the loan may also be entered.

Accordingly, in one embodiment of the invention a record-keeping system for tracking loaned articles includes a bound stack of sheets each having a first portion with a surface capable of receiving written information thereon, including information identifying a borrower of an article, the identity of the article and the date on which the article was borrowed. The stack of sheets is bound in such a way as to enable access to sheets below. A second portion of each sheet is attached to each first portion of each of the bound together sheets, with means permitting easy removal of the second portion from the first portion. The second portion includes surface means for enabling the entry of information relating to the loan of the article, including but not limited to the name of the owner and the date of the loan.

In one preferred embodiment, the second portion comprises a paper bookmark with styling indicating it as a bookmark, and the means for easy removal comprises a perforated tearable connection between the bookmark and the first portion.

It is therefore among the objects of the present invention to help assure that the generosity of a lender of books and other articles is rewarded by the eventual return of those articles. A simple, compact, efficient and effective device, system and method for recording article loan transactions and for reminding the borrowers to whom the article must be returned, eliminates the problems caused by passage of time and failure of memory as to return of loaned articles. These and other objects, advantages and features of the invention will be apparent from the following description of preferred embodiments, considered along with the accompanying drawings.

DESCRIPTION OF PREFERRED EMBODIMENTS

Figure 1:
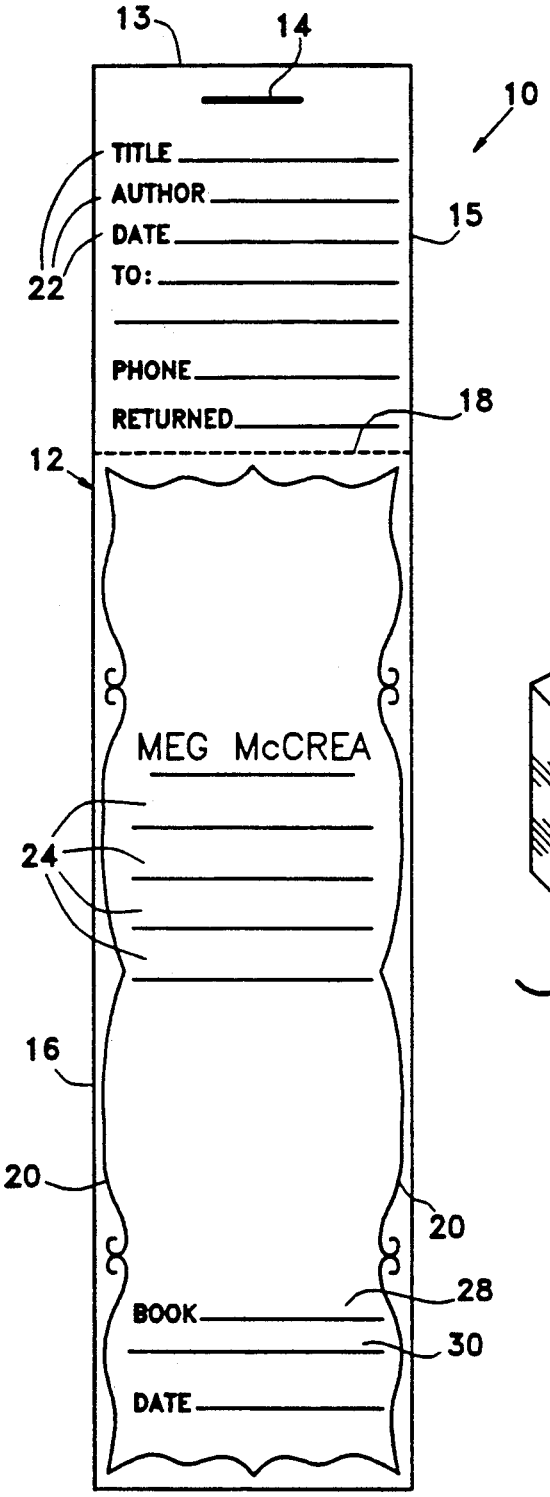
FIG. 1 is a plan view showing one embodiment of a device in accordance with the invention, for recording appropriate information as to articles loaned. The embodiment of FIG. 1 is particularly suitable for books.

In the drawings, FIG. 1 shows a device generally indicated by the reference number 10, for efficiently recording information relating to the lending of articles. The embodiment illustrated in FIG. 10 is particularly adaptable for books, magazines and other reading material, but it can also be used for other articles.

The recording device 10 includes a stack or pad of ticket-like sheets or slips 12, preferably of heavy paper material. The stack of ticket-like sheets 12 may be bound together by a staple 14 at the upper end, as illustrated, or other penetrating mechanical fasteners, or by gum bonding at the upper edges 13 of all the sheets in the well-known manner used for holding together a pad of paper. Other methods for bonding the stack together may be used, such as ring binders with holes through the upper ends of the ticket-like sheets, a tassel, ribbon or string through holes in the upper ends of the sheets (see FIG. 4), etc., so long as the binding method enables the sheets to be lifted open to enable the lender to review written material on each individual ticket or sheet, near the upper end as will be further explained below.

Each of the ticket-like sheets or slips 12 has two portions: a first or upper portion 15 which is kept by the owner/lender and which is retained preferably (but not necessarily) permanently in the bound stack 10. A second or lower portion 16 is removable from the first portion, and this may be via a line of perforations 18, enabling easy tear-off.

Figure 3:
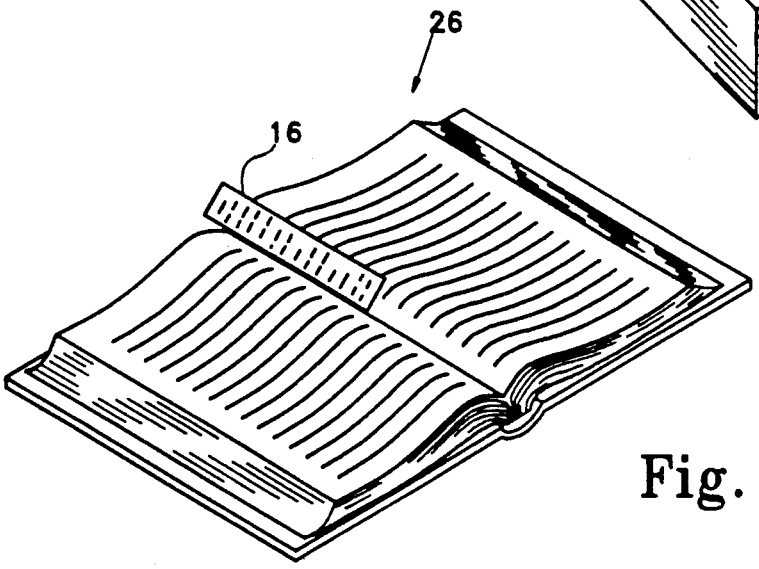
FIG. 3 is a view showing a bookmark as inserted in a book, after removal from the recording device shown in FIGS. 1 and 2.

In this specific embodiment, particularly adaptable for use with books, magazines and other printed materials, the second portion 16 comprises a bookmark. Thus, it is styled as a bookmark with indicia 20 tending to demonstrate its function to the borrower as a bookmark. Once torn off the first portion 15 of the ticket-like slip, the lower portion 16 becomes a bookmark, and preferably is inserted into a book, magazine or other reading material as shown in FIG. 3.

As shown in the drawings, the first or upper portion 15 of each sheet or slip 12 includes an area 22 for entry of information identifying the borrower of an article, as well as the identity of the article being lent. As also illustrated, spaces can also be provided for the date of the loan, the address and phone number of the borrower and for a later indication that the article has been returned.

The lower or second portion 16 of each ticket-like slip or sheet 12 also has provision for entry of information, or, alternatively, preprinted information giving the owner/lender's name and optionally, the address and phone number of the lender. The date of the loan can be entered manually. In the embodiment as illustrated, there are lines or spaces 24 for the entry of such information by hand.

As FIG. 1 illustrates, the second or lower portion 16 preferably also includes a space or line 28 to prompt entry of the name or title of the book or other article, with the loan date being entered in the space 30. This serves as a reminder to the borrower as to which book (or other article) was borrowed from the lender, in the event the bookmark/second portion 16 becomes separated from the borrowed article.

Thus, before a lender releases a book or other article, the appropriate information is entered onto the first or upper portion 15 of one of the ticket-like sheets or slips 12. The uppermost slip which has not been used (i.e. its lower portion has not been removed and its upper portion has not been written upon) in the pad or stack is selected. All of the appropriate information relating to the article and the borrower, the date, etc. is entered by the lender on the upper portion 15, and the appropriate information is also entered (or, in part, has been preprinted) on the second or lower portion 16. The lower portion is then removed via the tear-off line of perforations 18 and the resulting bookmark is inserted into the book 26 or other article, as indicated in FIG. 3.

Figure 4:
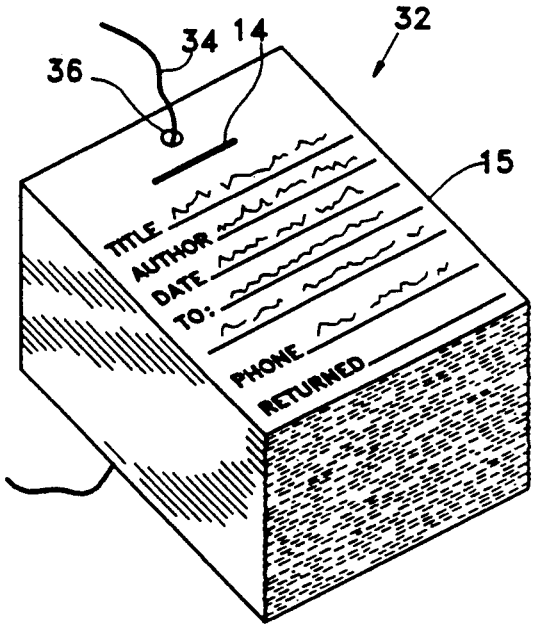
FIG. 4 is a perspective view showing a stack or pad of loan records, which remains after the device of FIGS. 1 and 2 has been fully used for loaned articles.
Figure 2:
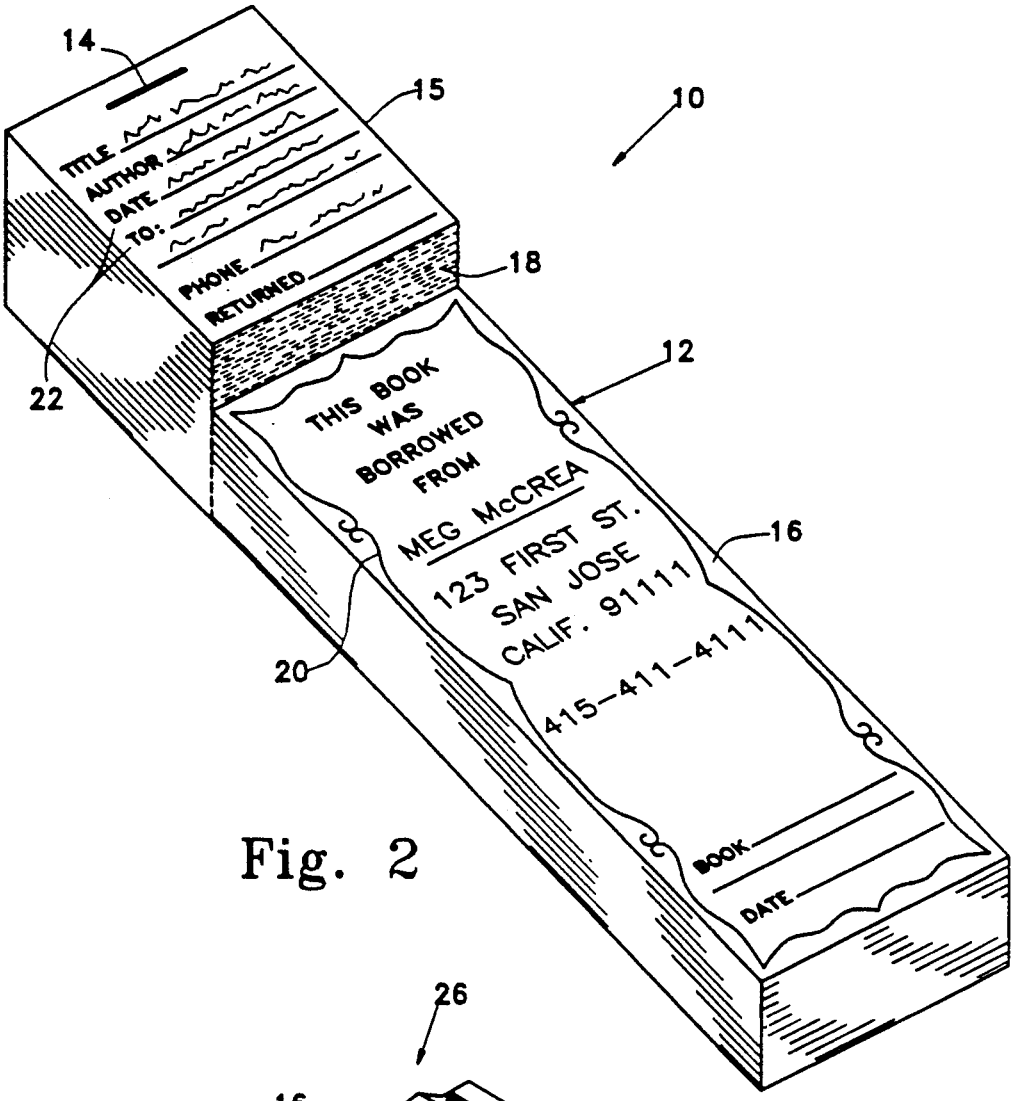
FIG. 2 is a perspective view of the embodiment of FIG. 1, showing the device after usage for a number of loaned books, magazines, or other reading materials or articles.

FIG. 4 shows a bound stack of the first portions 15 of the strips or slips 12, after the stack 10 shown in FIGS. 1 and 2 has been fully used by the lender. This stack 32 of "stubs" or records of loaned articles comprising first portions 15 serves as a permanent record for the lender-/owner of the articles. As indicated in FIG. 4, this stack 32 of records can be hung or tethered by a tassel, string or ribbon 34, to a desk, wall or to an appropriate position in the lender's library, in the case of books. The tassel, string or ribbon 34 may pass through a hole 36 penetrating each of the ticket-like stubs 15.

As mentioned above, it should also be understood that the tassel, string, ribbon or other tethering line 34 can serve as the sole means of binding the slips 12 (i.e. the first portions 15) together, if desired, with the staple 14, gumming or other binding means eliminated.

Figure 5:
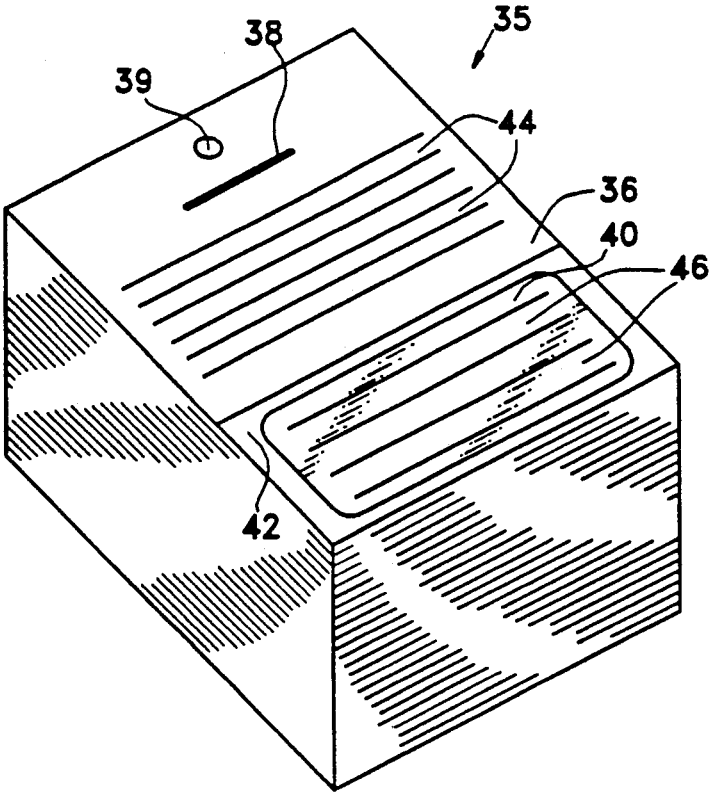
FIG. 5 is a perspective view showing another embodiment of a loan transaction record keeping device in accordance with the invention.

FIG. 5 shows an alternative embodiment of the invention, which can be in the form of a stack 35 of ticket-like slips 36, again held together by an appropriate binding means, such as a staple 38 or one or more holes 39 for a metal ring or for a tassel, string, cord or ribbon, as discussed above. The stack 35 may resemble the stack of records 32 shown in FIG. 4, but in this embodiment the tickets or slips 36 comprise the first portion of the recording device, and peel-off stickers 40 comprise the second portion.

As is well known, the paper, cardboard or plastic first portion 36 can have a thin coating of silicone or other material on the surface of its lower end, as indicated at 42. Such a surface will temporarily hold pressure sensitive adhesive contained on the back of the sticker 40, but will permit easy release and peeling off of the sticker 40, without leaving any gum or adhesive on the first portion 36. Other release surfaces (such as a plastic slip 36) can be used if desired. Thus, the first portion or retained records 36 of the stack 35 of record-keeping devices can have information entry spaces 44 similar to what is shown in FIGS. 1, 2 and 4 above. These give the owner/lender a record of the article being loaned, the date and the identity of the borrower and optionally the borrower's address and telephone number and return date. The peel-off stickers 40 are similar in function to the second portions 16 shown in FIGS. 1 and 2, with information entry spaces 46 for recording the name, address, etc. of the owner/lender and also the date the article was borrowed. As mentioned above, the information identifying the lender can be pre-printed if desired, but it is preferred that additional blank spaces be included for the handwritten entry of at least the date the loan is made.

Figure 6:
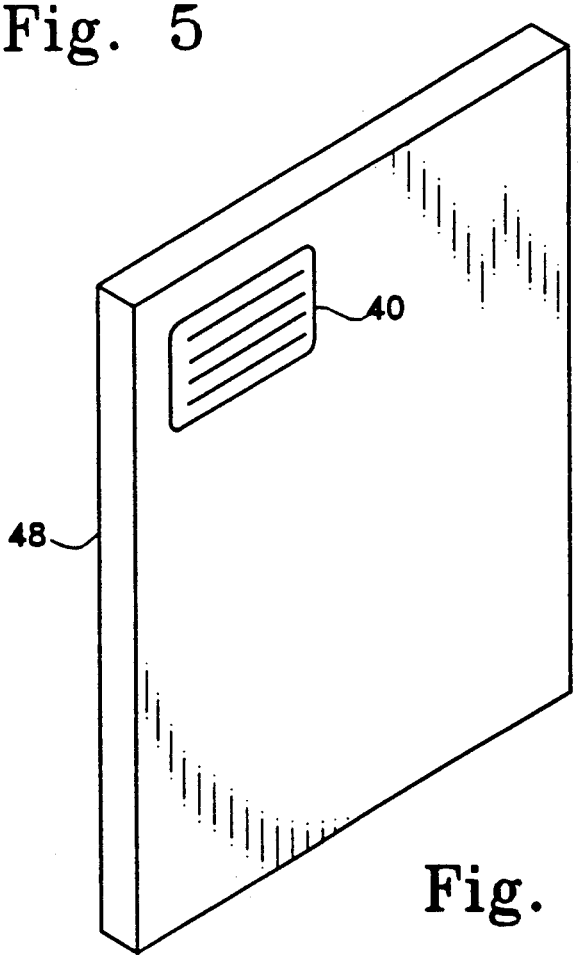
FIG. 6 is a perspective view showing a sticker label as removed from the device shown in FIG. 5 and applied to a loaned article.

FIG. 6 shows the sticker 40 as applied to an article 48 which is being lent to the borrower. The article 48 may be a phonograph record, an audio cassette, audio compact disc, video compact disc, various tools or other articles to be loaned by the owner. Also, the sticker 40 can be applied to a book, in lieu of the bookmark style ticket portion 16 described above, although the embodiment of FIGS. 1 through 4 is particularly advantageous for books, magazines and the like, since it provides the additional function of a bookmark.

Figure 7:
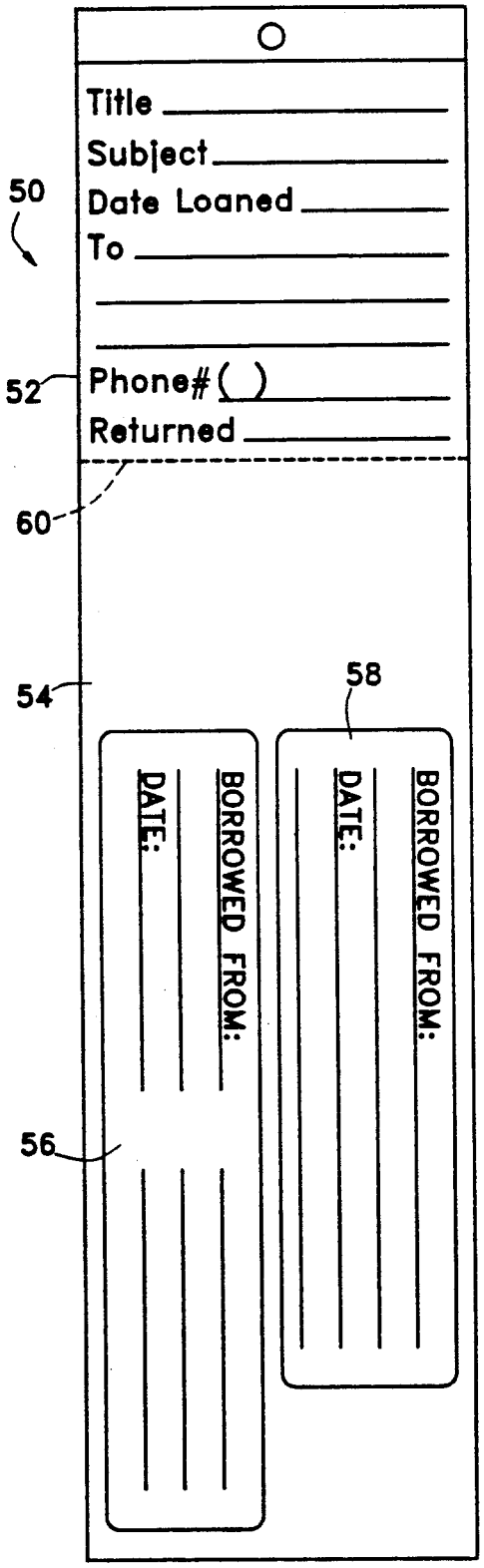
FIGS. 7 and 8 are plan views showing alternate forms of a loan transaction record keeping device, generally similar to that illustrated in FIG. 5.
Figure 8:
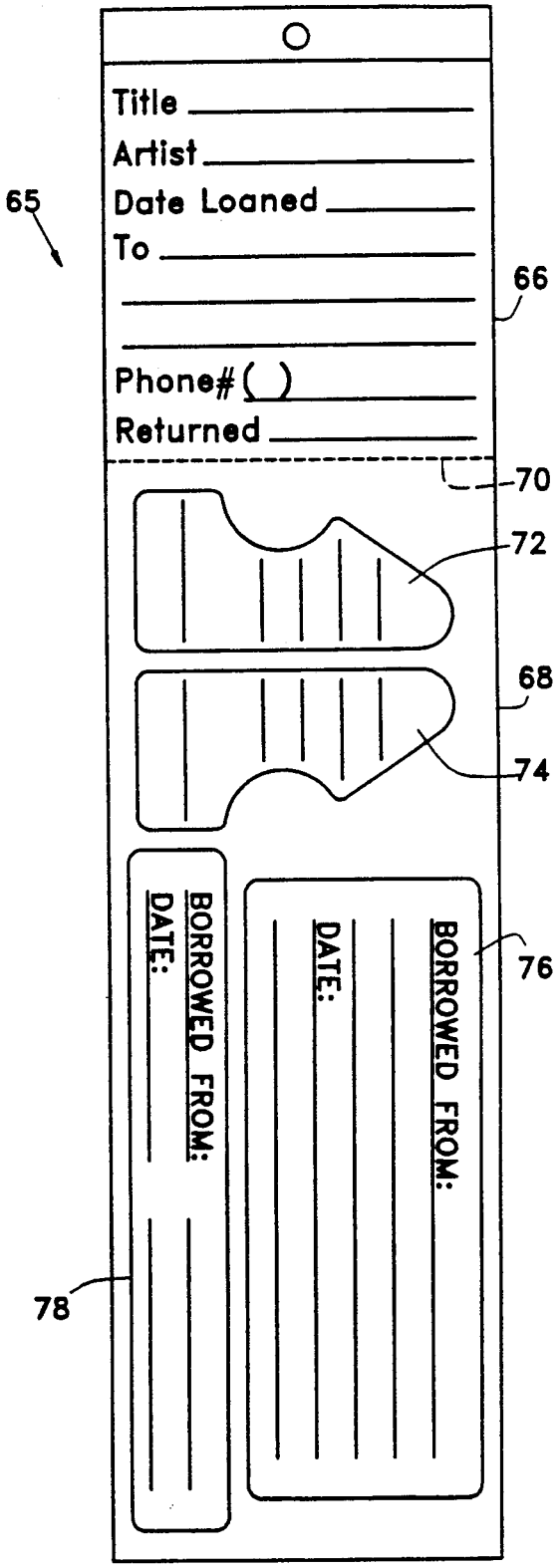

FIGS. 7 and 8 show other forms of the article loan recording device. Many further variations are possible. In FIG. 7, a configuration of a loan recording device 50 is shown, in an elongated format generally similar to FIG. 1. A first portion 52 is connected to a second portion 54 which bears one or several peel-off stickers 56, 58. The information recordable on the first portion 52 will be similar to that described above with respect to the embodiments of FIGS. 1 and 5. The information to be carried on the peel-off stickers 56 and 58 will be similar to that described with respect to the second portions 16 in the embodiments of FIGS. 1 and 5. If desired, the stickers 56 and 58 can carry identical information, but can be of different sizes as indicated, depending on the item to be lent. The configuration shown in FIG. 7 may be used for video tapes, tools or other such articles.

FIG. 7 also illustrates that, if desired, a line of perforations 60 can be provided to divide the second portion 54 from the first portion 52, similar to the embodiment of FIG. 1. In this way, the second portion substrate 54 can be thrown away after one or both of the stickers 56 and 58 have been attached to the article being borrowed. This provides for a more compact permanent record comprising the stack of first portions 52. Such perforations could be provided in the stack 35 of FIG. 5, if desired.

FIG. 8 shows a variation 65 which might be particularly adaptable for audio tapes, for example. The article loan recording device 65 has an upper or first portion 66 and a lower or second portion 68, which again may be separable via a line of perforations 70 as shown. In this case, second portion stickers 72, 74, 76 and 78 may be shaped specifically to conform to the type of article for which the loan recording device is intended. Thus, the stickers 72 and 74 are configured to fit around the drive sprockets of an audio tape. The two stickers illustrated could be formed as one single sticker in the general shape outlined, if desired. Similarly, the rectangular stickers 76 and 78 could be used on an audio tape or on a variety of different articles as desired. Each sticker should have space for appropriate information to be entered, or have the information preprinted to identify the owner/lender, phone number, etc., and preferably some additional space for indicating the date of the transaction, etc.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A record keeping device for use by a lender in keeping a record of loaned articles, comprising, a bound stack of sheets each having a first portion with a writing surface capable of receiving written information thereon, including information identifying a borrower of an article, the identity of the article and the date on which the article was borrowed, and with printed indicia and dedicated blank spaces prompting the lender to enter such information, the bound together sheets being bound in such a way as to enable access to sheets below, a second portion attached to each first portion on each of the bound together sheets, with means permitting easy removal of the second portion from the first portion while maintaining the first portion in the bound stack, and the second portion including a surface with information receiving means for enabling the entry of information relating to the loan of the article, including at least the name of the owner, whereby the second portion when removed from the first portion and secured to the loaned article serves as a constant reminder to the borrower.

2. The record keeping device of claim 1, wherein the second portion comprises a paper bookmark with styling indicating it as a bookmark and with an elongated and relatively narrow shape typical of bookmarks so as to reside near the bound edges of a book's pages when used in the book, and wherein the means permitting easy removal comprises a perforated tearable connection between the bookmark and the first portion.

3. The record keeping device of claim 1, wherein the second portion comprises a peel-off sticker having space for the entry of information on its top surface, and having pressure sensitive adhesive on its lower surface, and including release means on the sheet for holding the second portion via the pressure sensitive adhesive and for enabling easy removal of the peel-off sticker from the sheet with the pressure sensitive adhesive kept intact on the sticker.

4. The record keeping device of claim 3, wherein the second sticker portion is pre-printed with the name, address and telephone number of the lender.

5. The record keeping device of claim 3, wherein the second, sticker portion includes written indicia and dedicated blank spaced prompting the entry of at least the owner's name and the date of loan of the article.

6. A record keeping device for use by a lender for keeping a record of books as they are loaned subject to later return, comprising, a bound stack of sheet-like strips, each including a first portion to be retained by the owner of the book, and each having a tear-off second portion with means for permitting easy tear-off of the second portion from the first portion, the first portion having writing spaces on an upper surface dedicated to the written entry of information relating to the person to whom the book is lent and the identity of the book, and with printed indicia and dedicated blank spaces prompting the lender to enter such information, the second portion being in the shape and style of a bookmark, and having markings indicating its function as a bookmark and with an elongated and relatively narrow shape typical of bookmarks so as to reside near the bound edges of a book's pages when used in the book, with an upper end connected to the first portion by said means for easy tear-off, and the second portion having space for bearing information identifying the owner/lender of the book and also written indicia and dedicated blank spaced prompting the lender to enter the date of loan of the book, and the bound together sheet-like strips being bound in such a way as to enable access to sheets below, whereby, after appropriate information has been entered onto the first portion relating to the identity of the borrower and the book being loaned, and with appropriate information identifying at least the owner/lender of the book on the bookmark second portion, the bookmark second portion may be removed from the first portion of one of the strips, and inserted into the book being loaned, thereby providing the borrower with a reminder of the source of the book and also a bookmark for use with the book.

7. The record keeping device of claim 6, wherein the second portion includes written indicia and dedicated blank space prompting the entry of the owner's name and the title of the book.

* * * * *